United States Patent [19]

Bromfield

[11] Patent Number: 4,845,687

[45] Date of Patent: Jul. 4, 1989

[54] FLEXTENSIONAL SONAR TRANSDUCER ASSEMBLY

[75] Inventor: George Bromfield, Salt Lake City, Utah

[73] Assignee: EDO Corporation, Western Division, Salt Lake City, Utah

[21] Appl. No.: 190,454

[22] Filed: May 5, 1988

[51] Int. Cl.[4] ..... H04R 17/00; H04R 31/00

[52] U.S. Cl. ..... 367/158; 310/337; 367/165; 29/25.35

[58] Field of Search ..... 310/323, 325, 334, 337, 310/348; 367/156, 157, 158, 162, 165, 168, 155; 29/25.35, 594

[56] References Cited

U.S. PATENT DOCUMENTS

| | | | |
|---|---|---|---|
| 2,849,628 | 8/1958 | Hollmann | 367/157 |
| 3,718,897 | 2/1973 | Abbott | 367/157 |
| 4,420,826 | 12/1983 | Marshall, Jr. et al. | 367/167 |
| 4,731,764 | 3/1988 | Ponchaud | 367/158 |

*Primary Examiner*—Brian S. Steinberger

*Attorney, Agent, or Firm*—Thorpe, North & Western

[57] ABSTRACT

A flextensional sonar transducer assembly includes a stack of piezoelectric elements disposed along a linear axis, a plurality of electrodes disposed between the elements, end pieces disposed at each end of the piezoelectric stack, with the end pieces having outwardly facing, generally arcuate surfaces, a band of material formed into a loop to encircle the stack and end pieces, a flexural shell disposed to circumscribe the band of material to present a generally elliptical side cross-section, with the major axis thereof being generally coincident with the linear axis of the stack, and with the shell being reactively coupled to the arcuate end portions of the band of material so that a transverse movement of the long sides of the shell causes longitudinal compression or expansion of the elongate means and vice versa, and wedge elements positioned between the shell and the arcuate end portions of the band of material for maintaining driving contact between the shell and the end pieces.

19 Claims, 1 Drawing Sheet

FLEXTENSIONAL SONAR TRANSDUCER ASSEMBLY

BACKGROUND OF THE INVENTION

This invention relates to an improved flextensional sonar transducer assembly constructed to maximize operating depth by compensating for creep or movement, during use, between the outer flexural shell and the inner transducer driver.

Flextensional sonar transducers have been in use for some time in such applications as underwater sonar signal transmission detection. See U.S. Pat. Nos. 3,274,537, 3,277,433 and 4,462,093. Flextensional transducers typically employ a stack of piezoelectric transducer elements interspersed with electrically conducting plates for stressing the elements and for picking up electrical current produced by the elements, and an outer elliptically-shaped shell wrapped about the stack. The stack of piezoelectric elements generally extend along the major axis of the ellipse defined by the outer shell. When an alternating voltage is applied to the conducting plates, the stack of piezoelectric elements are caused to be displaced in the direction of the major axis in proportion to the instantaneous value of the voltage. The vibration and displacement of the stack is transmitted to the shell which amplifies the vibration along the minor access of the ellipse to produce the sonar signals. That is, as the stack expands to expand the major axis of the ellipse, the long walls of the ellipse perpendicular to the minor axis of the ellipse contract, and as the stack contracts to expand the long walls of the ellipse, vibration of the shell necessary to generate the sonar signals is produced. In an alternative arrangement of a flextensional transducer, a magnetostrictive drive element may replace the piezoelectric stack.

The elliptical shells used in flextensional transducers are typically pre-formed of filament wound composites or metals such as glass reinforced plastic or aluminum. In order to incorporate the stack of piezoelectric elements in the shell, the shell is compressed along its minor access by means of a press, and then the piezoelectric stack is inserted in the shell to coincide with the major access. The ends of the stack are attached to corresponding apices of the shell so that on removal of the compressive force from along the minor access, a residual tension remains in the shell to retain the stack and apply a predetermined compressive stress to the stack. Construction of the assembly in this fashion requires that the piezoelectric stack and elliptical shell be prepared to close tolerances both to allow for easy insertion of the stack within the compressed shell, and to retain tight contact between the stack and the shell upon removal of the compressive force.

An additional feature of some prior art flextensional transducers is the inclusion of a so-called pre-stress compression band, made for example of filament wound material, wrapped about the piezoelectric stack and circumscribed by the elliptical shell. This compression band allows for the application of a precise pre-stress (compression) to the piezoelectric stack. Such application of a pre-stress to the stack allows for accurate operation of the transducer in deep water. When the transducer assembly is deployed into water, the increasing hydrostatic pressure with depth reduces the prestress on the stack (since the elliptical shell tends to be compressed along the minor axis thus removing shell pressure along the major axis) and eventually a depth may be reached beyond which the transducer cannot be driven without damage. Use of the compression band enables reproduction of the same pre-stress levels from one transducer assembly to another.

One problem with the prior art flextensional transducers, whether the transducers employ the stress band or not, is that they can be rendered inoperable if used repeatably at significant water depths. This occurs when the hydrostatic pressure reduces the minor axis of the elliptical shell and extends the major axis of the shell to exceed the pre-stress of the shell so that the shell creeps or moves (elongates) relative to and then becomes detached and decoupled from either the compression band (if one is used) or from the ends of the piezoelectric stack (if a compression band is not used). Then, when the transducer assembly is brought from the water depth, the shell does not return to its original position of coupling between the stack and the shell so the assembly would not be reusable, at least at shallow depths. At deeper depths, the shell might be compressed enough along the minor axis to "squeeze" onto and couple with the band or stack and be operable. But each such use at the deeper depths causes further creep and decoupling until eventually the assembly becomes inoperable at any depth (at least any depth of interest).

SUMMARY OF THE INVENTION

It is an object of the invention to provide a flextensional sonar transducer which operates accurately and may be used repeatably at both shallow and deep water depths.

It is also an object of the invention to provide such a transducer in which the effect of creep (movement) of the shell relative to the piezoelectric stack is minimized.

It is a further object of the invention to provide such a transducer which is simple in design and easy to construct.

The above and other objects of the invention are realized in a specific illustrative embodiment of a flextensional sonar transducer assembly which includes a stack of piezoelectric elements disposed along a generally linear axis, a plurality of electrodes disposed between the elements, conductors coupled to the electrodes, end pieces placed at each end of the stack with the end pieces having outwardly facing, generally arcuate surfaces, and a flexural shell disposed to circumscribe and contact the end pieces. The flexural shell presents a generally elliptical side cross-section, with the major axis of the shell being generally coincident with the linear axis of the piezoelectric elements. Wedge members are positioned between the shell and the end pieces to compensate for longitudinal movement (and thus detachment) of the shell with respect to the end pieces and to maintain driving contact between the shell and piezoelectric stack. In accordance with one aspect of the invention, the wedge members are bonded to the shell and in contact with the end pieces. In accordance with another aspect of the invention, when a stress band is first wrapped about the piezoelectric stack and then the elliptical shell placed about the stress band, the wedge members are positioned between the shell and the stress band to compensate for longitudinal movement of the shell with respect to the band, i.e., to maintain driving contact between the band and shell.

In a specific embodiment of the wedge member, an arcuate element, enlarged at its ends and narrow in the middle, is disposed between the shell and an end piece so that the enlarged ends of the element are directed away from the shell apex with which the element is in contact.

BRIEF DESCRIPTION OF THE DRAWINGS

The above and other objects, features and advantages of the invention will become apparent from a consideration of the following detailed description presented in connection with the accompanying drawings in which.

DETAILED DESCRIPTION

Figure 1:
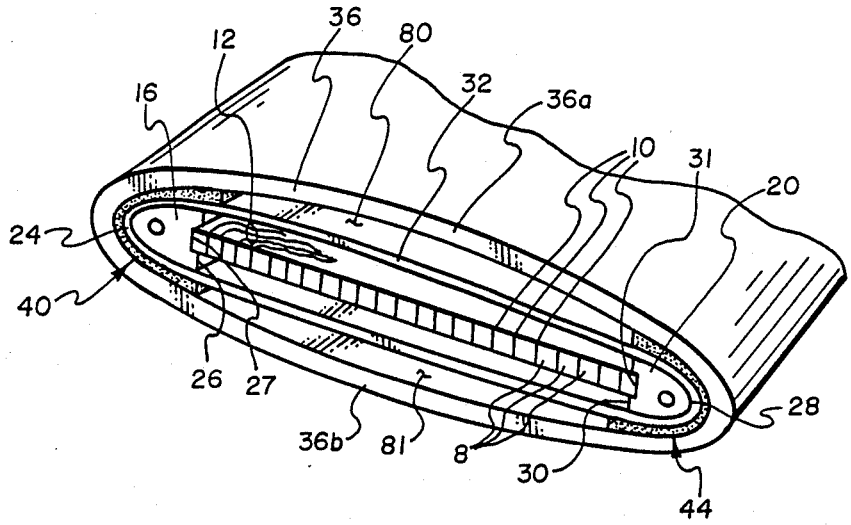
FIG. 1 shows a fragmented, perspective view of a flextensional sonar transducer assembly made in accordance with the principles of the invention.

Referring to FIG. 1, there is shown a perspective, partially fragmented view of an elliptical shell flextensional transducer assembly constructed for greater and repeatable depth capability than possible with currently used devices. The assembly includes a stack of piezoelectric elements or crystals 8 laid out in a linear array, with plate electrodes 10 disposed between the elements. Conductors 12 carry electrical signals to the electrodes 10 to stress the piezoelectric elements 8 and cause them to vibrate longitudinally along the axis of the array. The conductors 12 also carry electrical signals produced by the piezoelectric elements 8 when the elements intercept sonar signals, all in a well-known manner.

End pieces 16 and 20 are located at respective ends of the stack of elements 8 and intimately coupled therewith. The end pieces 16 and 20 are formed with outwardly facing, generally arcuate surfaces 24 and 28 respectively to accommodate a filament wound band of material 32 which is looped about the end pieces and stack of elements 8. The end pieces 16 and 20 also include opposed faces 26 and 30 in which are formed notches 27 and 31 respectively for fitting over respective ends of the stack of elements 8. The stack of elements 8 and end pieces 16 and 20 are initially joined together by an adhesive such as epoxy resin, and further held together and pre-stressed by the band 32, sometimes referred to as a compression band. The end pieces 16 and 20 might illustratively be made of aluminum, steel or hard plastic. The band 32 might illustratively comprise a relatively stiff filament-wound layer of material such as kevlar, E Glass, or S Glass, which would be formed and wound directly about the stack 8 and end pieces 16 and 20, and then cured (if curing were required) in a conventional fashion.

Circumscribing the band 32 is a flexural shell 36 preformed, for example, from filament wound composites, such as glass reinforced plastic, or metal such as aluminum. The shell 36 is formed to have a generally elliptical side cross-section, as shown in FIG. 1, with the major axis of the ellipse coinciding generally with the axis of the piezoelectric stack 8, and with the minor axis of the ellipse being generally perpendicular to the axis of the stack and to long walls **36*a* and 36*b*** of the shell.

In the prior art, the shell 36 typically is bonded at its apices to the end arcuate portions of the band 32. Then, when the transducer is used at certain depths where the pressure is great so that the long walls **36*a* and 36*b* of the shell 36** are compressed, i.e., the minor axis of the shell is contracted, beyond a certain threshold and the major axis is expanded, the shell apices may become detached from the band. This, of course, would impede or eliminate the transfer of energy between the shell and piezoelectric stack rendering the transducer unusable, at least at shallow depths as discussed earlier. With continued deployment at deeper depths, the transducer eventually becomes unusable because of continued creep of the shell and ultimate lack of driving contact between the shell and stack at any depth.

With the present invention, the effects of creep or longitudinal movement of the shell relative to the band are compensated for and essentially nullified. This is accomplished by incorporation of tapered wedge members 40 and 44 disposed between the shell 36 and compression band 32 at the apices of the shell (FIG. 1). Each wedge member is formed with an arcuate side cross-section, enlarged at the ends and narrower between the ends. Each wedge member is wrapped about a corresponding arcuate end portion of the band 32 so that the enlarged ends of said each wedge member are directed away from the apices of the shell 36 and toward the enlarged ends of the other wedge member. The wedge members 40 and 44 are bonded, for example by epoxy resin, at their outer surfaces to the inner surface of the shell 36, and in contact with but not bonded to the outer surface of the band 32. The wedge members 40 and 44 extend from one side of the shell, along the apices to the other side thereof. Advantageously, those portions of the wedge members 40 and 44 in contact with the band 32 are contoured to conform to the outer surface of the band. The wedge members 40 and 44 might illustratively be made of aluminum, steel or hard plastic. Although not shown, suitable side plates would be placed on each side of the shell 36 to seal the interior of the shell from introduction of water, all of which is well known.

Figure 2:
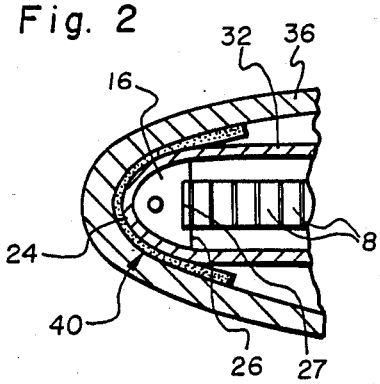
FIG. 2 shows a side, cross-sectional view of one end of the assembly of FIG. 1.

FIG. 2 shows a fragmented side, cross-sectional view of the transducer assembly of FIG. 1. In this embodiment, the wedge members 40 and 44 are in contact with band 32 substantially along the entire interior surface of the wedge members, as best seen in FIG. 2.

Figure 3:
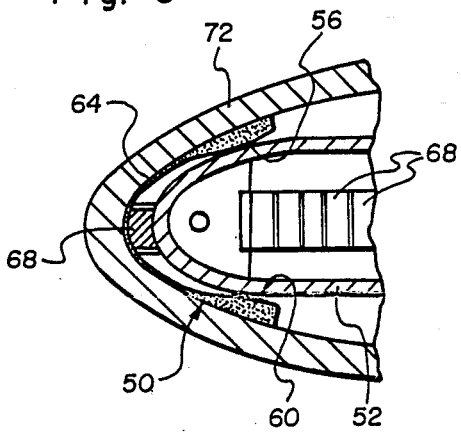
FIG. 3 shows a side, cross-sectional view of an alternative embodiment of a flextensional sonar transducer assembly made in accordance with the present invention.

In another embodiment of the invention, shown in FIG. 3, a wedge member 50 contacts the compression band 52 at driving locations 56 and 60, where the greatest force is applied to the shell 64 by the stack of elements 68 and band 52 when the elements are caused to vibrate (expand and contract). At the narrower portion 64 of the wedge member 50, there is no contact with the band 52, but rather a shim 68 is disposed between the band and the wedge member at the apex of the assembly to extend the width thereof. The shim 68, which would be placed in position while compressing the shell 72 along its minor axis to lengthen the major axis and produce a gap between the wedge member 50 and band 52 for insertion of the shim, serves to hold the wedge member in locations 56 and 60. The shim 68 may advantageously be made of brass or aluminum.

The transducer assembly described above may advantageously be constructed by first assembling a stack of piezoelectric elements generally along a linear axis and between opposed end pieces, of course with the appropriate electrodes disposed between the elements. The stack is secured together by a suitable adhesive such as epoxy resin. Next, a layer of stiff filament-wound material is wound about the stack and opposed end pieces under stress to provide the appropriate amount of prestress for the stack. Wedge members are then placed in contact with the arcuate end portions of the filament layer and the flexural shell is formed about the wedge members and bonded thereto to present a generally elliptical side cross-section. If the shell is formed of a filament wound composite material, top and bottom formers, having eliptically contoured outer surfaces, may be positioned on top of and underneath the compression band in spaces 80 and 81 of FIG. 1 to facilitate the winding process. In other words, the formers, along with the wedge members would serve as a mandrel about which the composite material could be wound. The formers could illustratively be made of plaster or other reducible material which after the winding of the shell was completed, could be easily removed. If shims, such as shim 68 of FIG. 3, are used, then the assembly would be compressed to allow insertion of the shim or shims as discussed earlier.

Although two wedge members with arcuate cross sections are shown for the two embodiments, four separate wedge members could be provided in which case the wedge members would be inserted at the locations of the enlarged ends of the arcuate wedge members, i.e., at driving locations such as locations 56 and 60 of FIG. 3, with there being no connection of the narrower portion of a wedge member with the narrower portion of any other wedge member.

Although the above description of illustrative embodiments was made with respect to a stack of piezoelectric elements, it should be understood that magnetostrctive devices could also be used in place of the piezoelectric stack.

Finally, if no compression band were desired or needed, such a band could be omitted from the assembly in which case the wedge members would be placed in contact with end pieces 16 and 20 (FIG. 1), rather than with the band.

It is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements.

What is claimed is:

1. A flextensional sonar transducer assembly including a stack of piezoelectric elements disposed along a linear axis, a plurality of electrodes disposed between the elements, means for conducting electrical signals to and from the electrodes, end pieces disposed at each end of the stack, said end pieces having outwardly facing, arcuate surfaces, a band of material formed into a loop to extend along one side of the stack, arcuately about one end piece and back along the other side of the stack, and arcuately about the other end piece to said one side, a flexural shell disposed to circumscribe the band of material to present an elliptical side cross-section, with the major axis thereof being generally coincident with said linear axis, and with the shell being reactively coupled to the arcuate end portions of the band of material so that an inwardly directed transverse movement of the long sides of the shell toward said stack causes longitudinal expansion of the stack and an outwardly directed transverse movement of the along sides of the shell away from the stack causes longitudinal compression of the stack of elements, and wedge means positioned between the shell and the arcuate end portions of the band of material for maintaining driving contact between the arcuate end portions of the band of material and the shell.

2. An assembly as in claim 1 wherein said wedge means is bonded to the shell.

3. An assembly as in claim 2 wherein said wedge means is in contact with the band of material, but not bonded thereto.

4. An assembly as in claim 3 wherein said wedge means is bonded to the shell by epoxy resin.

5. An assembly as in claim 1 wherein the wedge means comprises four tapered elements, each having an enlarged end and a narrower end, and each disposed between the shell and band of material adjacent respective side corners of each end of the stack, with the enlarged ends of each element directed away from the apices of the shell.

6. An assembly as in claim 5 wherein the tapered elements are bonded to the shell and are in contact with the band of material.

7. An assembly as in claim 6 wherein the side of each tapered element in contact with the band of material is contoured to conform to the exterior surface of the band of material.

8. An assembly as in claim 1 wherein the wedge means comprises at least one arcuate element, enlarged at the ends and narrower in the middle, and disposed between the shell and band of material at an apex of the shell so that the enlarged ends of the arcuate elements are directed away from the apex.

9. An assembly as in claim 8 wherein the arcuate element is bonded to the shell, and wherein the enlarged ends of the arcuate element are in contact with the band of material.

10. An assembly as in claim 9 wherein those portions of the arcuate elements in contact with the band of material are contoured to conform to the exterior surface of the band of material.

11. An assembly as in claim 9 further including a shim means disposed between the band of material and the shell.

12. An assembly as in claim 1 wherein the wedge means are made of aluminum.

13. An assembly as in claim 1 wherein the band of material comprises a filament wound layer of material, and wherein said shell comprises a filament wound layer of different material.

14. An assembly as in claim 13 wherein the band of material is wrapped about the stack under stress.

15. A method of constructing a flextensional sonar transducer comprising the steps of:

(a) assembling a stack of piezoelectric elements along a linear axis and between opposed end pieces, with electrodes being disposed between the elements, (b) winding a layer of filament about the stack and opposed end pieces, with the filament extending arcuately about the end pieces, (c) placing wedge elements in contact with each arcuate end portion of the filament layer, said wedge elements being formed of two arcuate elements, each having enlarged ends with narrower middle sections, and the step of placing the wedge elements including positioning each wedge element between the shell and filament layer so that the enlarged end of the arcuate elements are directed away from the apices of the shell, and (d) forming a flexural shell having an elliptical side cross-section, to circumscribe the wedge elements and filament layer and to contact the wedge elements.

16. A method as in claim 15 further comprising the step of bonding the interior surfaces of the apices of the shell to the wedge elements.

17. A method as in claim 16 wherein the arcuate elements are formed so that the portions thereof in contact with the filament layer are contoured to conform to the exterior contact surfaces of the filament layer.

18. A flextensional sonar transducer assembly including elongate means disposed along a linear axis for expanding and contracting longitudinally in response to electrical signals being applied thereto and for producing electrical signals when stressed longitudinally, means for conducting electrical signals to and from the elongate means, end pieces disposed at each end of the elongate means, said end pieces having outwardly facing, arcuate surfaces, a band of material formed into a loop to encircle the elongate means and end pieces, a flexural shell disposed to circumscribe the band of material to present an elliptical side cross-section, with the major axis thereof being generally coincident with said linear axis, and with the shell being reactively coupled to the arcuate end portions of the band of material so that an inwardly directed transverse movement of the long sides of the shell toward said stack causes longitudinal expansion of the stack and an outwardly directed transverse movement of the long sides of the shell away from said stack causes longitudinal compression of the elongate means, and wedge means positioned between the shell and the arcuate end portions of the band of material for coupling movement of the shell to the arcuate end portions of the band of material, and for coupling movement of the arcuate end portions of the band of material to the shell.

19. A flextensional sonar transducer assembly including elongate means disposed along a linear axis for expanding and contracting longitudinally in response to electrical signals being applied thereto and for producing electrical signals when stressed longitudinally, means for conducting electrical signals to and from the elongate means, end pieces disposed at each end of the elongate means, said end pieces having outwardly facing, arcuate surfaces, a flexural shell disposed to circumscribe the elongate means and end pieces to present an elliptical side cross-section, with the major axis thereof being generally coincident with said linear axis, and with the shell being reactively coupled to the end pieces so that an inwardly directed transverse movement of the long sides of the shell toward said stack causes longitudinal expansion of the stack and an outwardly directed transverse movement of the long sides of the shell away from said stack causes longitudinal compression of the elongate means, and wedge means positioned between the shell and the end pieces for maintaining driving contact between the shell and the end pieces.

* * * * *